US006935318B2

(12) United States Patent
Abidi et al.

(10) Patent No.: US 6,935,318 B2
(45) Date of Patent: Aug. 30, 2005

(54) EVAPORATED FUEL PROCESSING DEVICE

(75) Inventors: Mostafa Abidi, Luxembourg (FR); Christian Gerard Hillard, Talange (FR); Remi B Loevenbruck, Athus (FR)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/826,872

(22) Filed: Apr. 16, 2004

(65) Prior Publication Data

US 2004/0261773 A1 Dec. 30, 2004

(Under 37 CFR 1.47)

(30) Foreign Application Priority Data

Apr. 23, 2003 (EP) ..... 03101117

(51) Int. Cl.[7] ..... F02M 33/02
(52) U.S. Cl. ..... 123/519; 123/520; 96/149
(58) Field of Search ..... 123/516, 518, 123/519, 520, 521; 96/137, 149, 152, 151; 55/385.3

(56) References Cited

U.S. PATENT DOCUMENTS 4,496,379 A * 1/1985 Kozawa ..... 96/130
4,766,872 A * 8/1988 Kato et al. ..... 123/519
5,408,976 A * 4/1995 Reddy ..... 123/519
5,599,384 A * 2/1997 Yoshida et al. ..... 96/143
5,632,808 A * 5/1997 Hara et al. ..... 96/137
5,641,344 A * 6/1997 Takahashi et al. ..... 96/139
5,718,209 A 2/1998 Scardino et al.
6,431,156 B1 * 8/2002 Murakami et al. ..... 123/520
6,460,516 B2 * 10/2002 Kimoto et al. ..... 123/519
6,503,301 B2 * 1/2003 Uchino et al. ..... 96/132
6,551,388 B1 * 4/2003 Oemcke et al. ..... 96/149
6,695,896 B2 * 2/2004 Hara et al. ..... 96/121
2001/0039881 A1 11/2001 Moriyama et al.
2002/0007826 A1 1/2002 Yamada et al.
2002/0026874 A1 3/2002 Ikuma et al.
2002/0078931 A1 * 6/2002 Makino et al. ..... 123/519

FOREIGN PATENT DOCUMENTS

EP 0512597 11/1992

* cited by examiner

*Primary Examiner*—Carl S. Miller
(74) *Attorney, Agent, or Firm*—Jimmy L. Funke

(57) ABSTRACT

An evaporated fuel processing device, in particular for an internal combustion engine of an automotive vehicle, comprises a tank port (14) and an atmospheric port (26); a first adsorbent chamber (16) between the tank port (14) and the atmospheric port (26), the first adsorbent chamber (16) being filled with an adsorbent material (18); and a volume compensator (24) for compacting the adsorbent material (18) in the first adsorbent chamber (16). The volume compensator (24) comprises a base (34); a compacting plate (30); and a spring (32) arranged between the base (34) and the compacting plate (30). The volume compensator (24) further comprises resilient connecting means (36) connecting the compacting plate (30) to the base (34), the resilient connecting means (36) being formed in one piece with the compacting plate (30) and the base (34) and being arranged such that the spring (32) can be inserted between the base (34) and the compacting plate (30).

15 Claims, 3 Drawing Sheets

EVAPORATED FUEL PROCESSING DEVICE

FIELD OF THE INVENTION

The present invention generally relates to an evaporated fuel processing device, in particular for an internal combustion engine of an automotive vehicle, comprising an evaporative canister.

BACKGROUND OF THE INVENTION

There are three main sources of polluting gasses from an internal combustion engine: engine exhaust, crankcase, fuel supply systems. In the fuel tank, the hydrocarbons that are continually evaporating from the fuel constitute a significant contributing factor to air pollution.

To control the air pollution resulting from these emissions, governments establish quality standards and perform inspections to ensure that standards are met. Standards have become progressively more stringent, and the equipment necessary to meet them has become more complex. Emissions from the fuel tank are reduced by an evaporated fuel processing device, the heart of which is an evaporative canister of activated carbon capable of holding fuel vapor. In operation, the fuel tank vapors flow from the fuel tank to a liquid-vapor separator that returns the raw fuel to the tank and channels the fuel vapor to the canister. The evaporative canister acts as a storehouse; when the engine is running, the vapors are purged from the evaporative canister through the purge port into the combustion chamber, where they are burnt.

An evaporative canister is e.g. known from U.S. patent application US-A-2002/0007826. The evaporative canister is a typically vertical-placed type integrated canister connected to a fuel tank. Evaporated fuel from the fuel tank is led to the evaporative canister via an evaporated fuel passage and, optionally, a liquid-vapor separator. The latter traps the fuel in a liquid phase. The fuel in the vapor phase only is fed into the canister via a tank port. The air/fuel vapor mixture first flows through a first adsorbent chamber comprising an adsorbent material and then through a second adsorbent chamber also comprising an adsorbent material. As the air/fuel vapor mixture flows through the first and second adsorbent chambers, the fuel component of the mixture is adsorbed by the adsorbent material and purified air exits the canister via an atmospheric port. During operation of the engine, air is drawn through the canister from the atmospheric port, through the second and first adsorbent chambers, and out via a purge port. As the air passes through the second and first adsorbent chambers the air desorbs the fuel component from the adsorbent material, whereby the latter is regenerated. The purge port is connected to the internal combustion engine, where the fuel component is then burnt.

In order to efficiently adsorb fuel components, the adsorbent material in the adsorbent chambers should be compacted. Generally, the adsorbent material is maintained in a compact state by means of a volume compensator, which is fluidly arranged between the first and second adsorbent chambers. Such a volume compensator comprises compacting plates, for compacting the adsorbent material by means of springs.

During the assembly of the volume compensator, a spring is connected to a compacting plate. A first end portion of the spring is engaged in lugs arranged in the compacting plate and a second end portion of the spring is furthermore connected to a base. It will be appreciated that the assembly of the volume compensator and hence of the evaporated fuel processing device can be cumbersome and time consuming.

SUMMARY OF THE INVENTION

The object of the present invention is hence to provide an evaporated fuel processing device that can be more easily assembled.

The present invention proposes an evaporated fuel processing device, in particular for an internal combustion engine of an automotive vehicle, comprising a tank port and an atmospheric port; a first adsorbent chamber between the tank port and the atmospheric port, the first adsorbent chamber being filled with an adsorbent material; and a volume compensator for compacting the adsorbent material in the first adsorbent chamber. The volume compensator comprises a base; a compacting plate; and a spring arranged between the base and the compacting plate. According to an important aspect of the invention, the volume compensator further comprises resilient connecting means connecting the compacting plate to the base, the resilient connecting means being formed in one piece with the compacting plate and the base and being arranged such that the spring can be inserted between the base and the compacting plate.

The connecting means connects the compacting plate to the base, and maintains in a spaced relationship thereto. Due to the fact that the connecting means is resilient, relative movement of the compacting plate with respect to the base is possible in a direction substantially perpendicular to the compacting plate or the base. The resilient connecting means can e.g. be molded together with the compacting plate and the base. As all of these elements are formed in one piece, fewer elements need to be handled during the assembly stage. Indeed, only the spring needs to be inserted between the compacting plate and the base. It follows that the volume compensator can be more easily assembled. Furthermore, assembly time of the volume compensator—and thereby also of the evaporated fuel processing device—can be reduced.

The resilient connecting means preferably comprises first and second resilient bands; the first and second resilient bands being diametrically arranged in a peripheral zone of the compacting plate. The first and second resilient bands connect the compacting plate to the base and maintain it in a spaced relationship thereto. The resilient connecting means can further comprise a third resilient band, the third resilient band being arranged between the first and second resilient bands in the peripheral zone of the compacting plate. Furthermore, it is not excluded to provide more resilient bands, as long as the spring can still be inserted in the space between the compacting plate and the base.

Preferably, the resilient bands have larger width than thickness. Such a larger width gives the resilient band some rigidity in one direction so that a tipping movement of the compacting plate with respect to the base can be limited. In the case of two diametrically arranged resilient bands, tipping movement of the compacting plate about an axis comprising the centre of the two resilient bands is limited. In the case of a third resilient band, arranged half-way between the first and second resilient bands, the third band is arranged perpendicularly to the first and second resilient bands. This means that tipping movement of the compacting plate about an axis perpendicular to the axis comprising the centre of the two resilient bands is also limited. The preferred dimensions of the resilient bands depend on the chosen material. The person skilled in the art will choose dimensions so that the resilient bands have enough resilience to move the compacting plates sufficiently so as to always maintain the adsorbent material in a compact state.

The resilient bands can have zigzagged or curved profile to confer the necessary flexibility to the resilient bands. However, it is not excluded to provide the resilient bands with another convenient profile. In a desired bending area, a zigzagged resilient band can have a groove in one face so as to facilitate bending of the resilient band.

The base preferably comprises a first receiving portion for receiving the spring. Similarly, the compacting plate preferably comprises a second receiving portion for receiving the spring. By means of the receiving portions, the spring can be maintained in place once installed between the compacting plate and the base.

Advantageously, the receiving portions protrude into an area between the base and the compacting plate, and the receiving portions have a cross-section substantially corresponding to the inner cross-section of the spring. The ends of the spring can then simply be received on the respective receiving portions without having to be connected to the compacting plate or the base. In a compressed state, the spring can be passed over the receiving portions and, once in place, the spring is allowed to expand so that the ends of the spring surround the respective receiving portions. Movement of the spring in a direction of the plane of the base or compacting plate is hence avoided. The spring is securely maintained in place between the base and the compacting plate.

Alternatively, the receiving portions can be formed by a recess arranged in the base and the compacting plate respectively, and the receiving portions have a cross-section substantially corresponding to the outer cross-section of the spring. The ends of the spring can then simply be received in the recesses of the respective receiving portions without having to be connected to the compacting plate or the base.

The first receiving portion can be formed in one piece with the base, and the second receiving portion can be formed in one piece with the compacting plate.

According to a preferred embodiment, the evaporated fuel processing device further comprises a second adsorbent chamber arranged between the first adsorbent chamber and the atmospheric port, the second adsorbent chamber being filled with an adsorbent material. The volume compensator then preferably comprises a first compacting plate associated with a first spring for compacting the adsorbent material in the first adsorbent chamber, and a second compacting plate associated with a second spring for compacting the adsorbent material in the second adsorbent chamber. By providing a second adsorbent chamber, the length of the fluid path in the evaporated fuel processing device is increased, thereby increasing the efficiency thereof. Also, a U-flow configuration can be formed, thereby allowing the tank port and the atmospheric port to be located on the same side of the evaporated fuel processing device.

The volume compensator is preferably fluidly arranged between the first and second adsorbent chambers, the volume compensator defining a compensator chamber, and the first and second compacting plates comprise passages having a cross-section allowing an air/fuel vapor mixture to pass through the passages but preventing the adsorbent material to pass through the passages. The air/fuel vapor mixture flows through the first adsorbent chamber to the first compacting plate and passes through the passages therein to arrive in the compensator chamber. From there, the air/fuel vapor mixture can then enter the second adsorbent chamber through the passages in the second compacting plate before leaving the evaporated fuel processing device via the atmospheric port.

The evaporated fuel processing device advantageously further comprises a third adsorbent chamber arranged between the second adsorbent chamber and the atmospheric port, the third adsorbent chamber being filled with an adsorbent material, wherein the evaporated fuel processing device comprises a further volume compensator for compacting the adsorbent material in the third adsorbent chamber. The third adsorbent chamber allows the device to adsorb any remaining fuel component from the air/fuel vapor mixture before the vapor escapes into the atmosphere via the atmospheric port.

The adsorbent material preferably comprises activated carbon.

The evaporated fuel processing device advantageously further comprises a purge port connected to the first adsorbent chamber, so that fresh air can be drawn from the atmospheric port through the adsorbent chambers to the purge port. By drawing fresh air through the adsorbent chambers, the drawn air desorbs the fuel components from the adsorbent material, i.e. fuel components can be stripped off the adsorbent material trapped therein. The adsorbent material can thereby be regenerated during engine operation.

Advantageously, the purge port is connected to a combustion chamber of an internal combustion engine, so that the fuel component from the evaporated fuel processing device can be burnt during engine operation.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
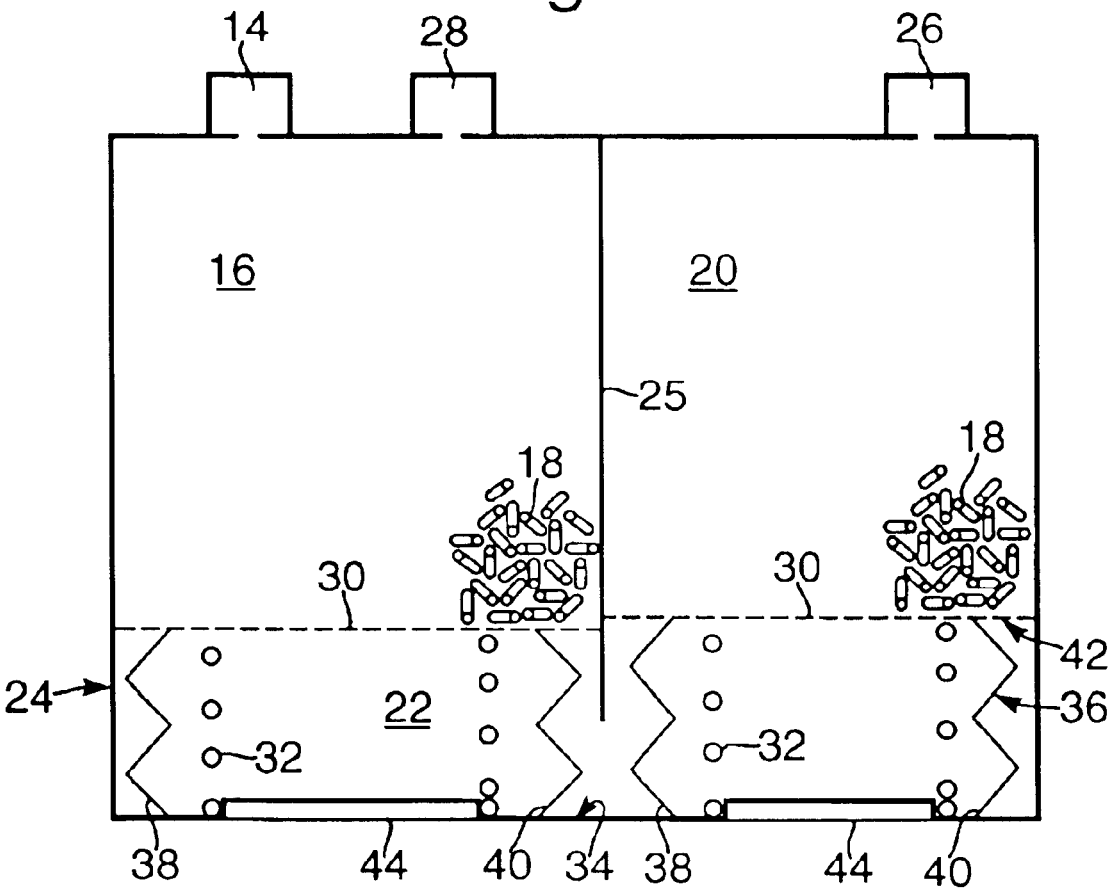
FIG. 1 is a section view through an evaporative canister of an evaporated fuel processing device according to the invention.

A preferred embodiment of an evaporative canister 10 of an evaporated fuel processing device is shown in FIG. 1. The evaporative canister 10 shown in this figure is a vertical-placed type integrated canister connected to a fuel tank (not shown). Evaporated fuel from the fuel tank is led to the evaporative canister 10 via an evaporated fuel passage and, optionally, a liquid-vapor separator (not shown). The latter traps the fuel in a liquid phase. The fuel in the vapor phase only is fed into the canister 10 via a tank port 14. The air/fuel vapor mixture first flows through a first adsorbent chamber 16 comprising an adsorbent material 18 and then through a second adsorbent chamber 20 also comprising an adsorbent material 18. Generally, the adsorbent material 18 is activated carbon. The first and second adsorbent chambers 16, 20 are typically connected via a compensator chamber 22 of a volume compensator 24. A partition wall 25 is arranged between the first and second adsorbent chambers 16, 20 and extends into the compensator chamber 22. Within the compensator chamber 22, the partition wall 25 comprises an opening to allow air/fuel vapor mixture to flow from one adsorbent chamber 16, 20 to the other. As the air/fuel vapor mixture flows through the first and second adsorbent chambers 16, 20, the fuel component of the mixture is stripped from the mixture and is trapped in the adsorbent material 18, so that purified air exits the canister 10 via an atmospheric port 26. During operation of the engine, air is drawn through the canister 10 from the atmospheric port 26, through the second and first adsorbent chambers 20, 16, and out via a purge port 28. As the air passes through the second and first adsorbent chambers 20, 16, the air desorbs the fuel component from the adsorbent material 18, whereby the latter is regenerated. The purge port 28 is connected to a combustion chamber of an internal combustion engine (not shown), where the fuel component is then burnt.

It is to be noted that it is desirable to compact the adsorbent material 18 in the adsorbent chambers 16, 20 in order to efficiently adsorb fuel components. The adsorbent material 18 is therefore maintained in a compact state by means of the volume compensator 24. Such a volume compensator 24 comprises a compacting plate 30, for compacting the adsorbent material 18 by means of a spring 32. The volume compensator 24 shown in FIG. 1 comprises two such compacting plates 30, associated with two springs 32 for compacting the adsorbent material 18 in the first and second adsorbent chambers 16, 20 respectively.

Figure 2:
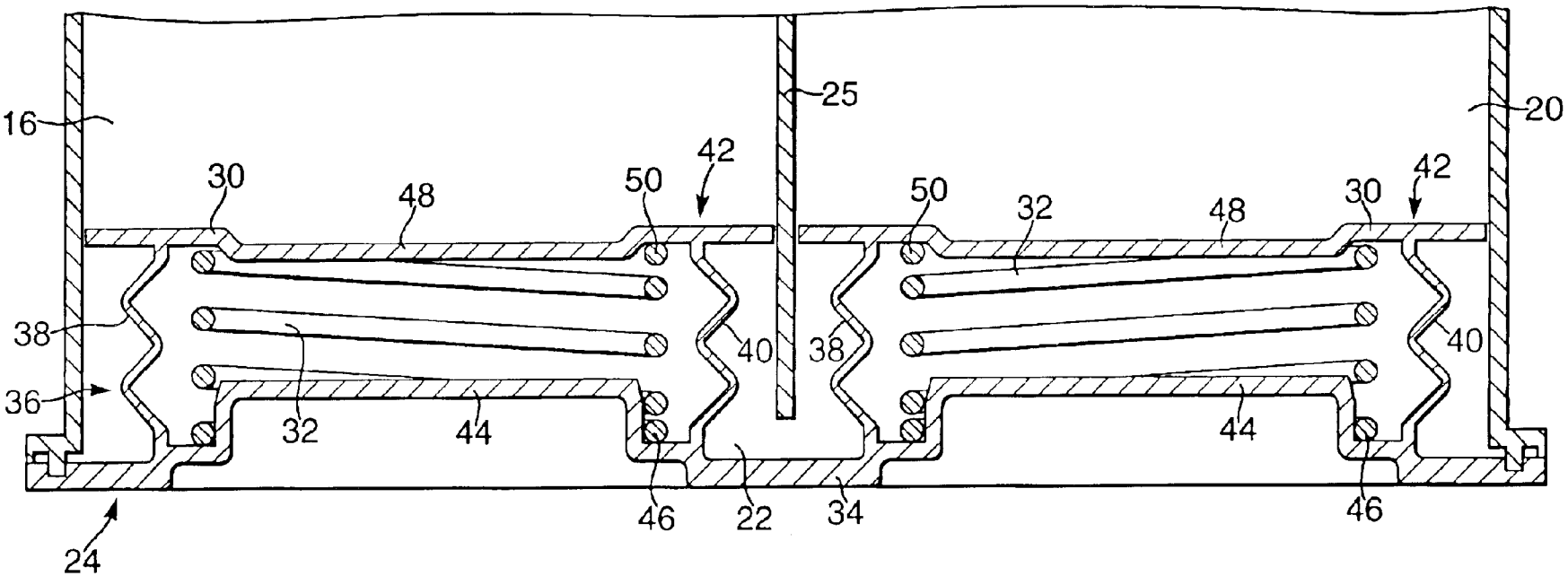
FIG. 2 is a section view through the volume compensator of the evaporative canister of FIG. 1.

According to the invention and as shown in FIGS. 1 and 2, the compacting plate 30 is connected to a base 34, which can be a cover of the evaporative canister 10, by means of resilient connecting means 36 being formed in one piece with the compacting plate 30 and the base 34. The resilient connecting means 36 maintains the compacting plate 30 in a spaced relationship with respect to the base 34 and is arranged such that the spring 32 can be inserted between the base 34 and the compacting plate 30. The resilient connecting means 36 allows relative movement of the compacting plate 30 with respect to the base 34 in a direction substantially perpendicular to the compacting plate 30 or to the base 34. Preferably, the resilient connecting means 36 is molded together with the compacting plate 30 and the base 34. The assembly of the volume compensator 24 is simpler and faster due to the fact that fewer elements need to be handled during the assembly stage and that only the spring 32 needs to be inserted between the compacting plate 30 and the base 34.

The resilient connecting means 36 shown in FIGS. 1 and 2 comprises a first resilient band 38 and a second resilient band 40. The first and second resilient bands 38, 40 are diametrically arranged in a peripheral zone 42 of the compacting plate 30 and connect the compacting plate 30 to the base 34. It is also possible, although not shown in the figures, to provide further resilient bands in the peripheral zone 42 of the compacting plate 30, as long as the spring 32 can still be inserted between the space between the compacting plate 30 and the base 34.

The resilient bands 38, 40 have larger width than thickness. Such a width gives the resilient bands 38, 40 some rigidity in one direction, so that a tipping movement of the compacting plate 30 with respect to the base 34 can be limited. In the case of two diametrically arranged resilient bands 38, 40, tipping movement of the compacting plate 30 about an axis comprising the centre of the two resilient bands 38, 40 is limited. The preferred dimensions of the resilient bands 38, 40 depend on the chosen material. The person skilled in the art will choose dimensions so that the resilient bands 38, 40 have enough resilience to move the compacting plates 30 sufficiently so as to always maintain the adsorbent material 18 in a compact state. By increasing the width of the resilient bands 38, 40 with respect to their thickness, tipping movement of the compacting plate 30 with respect to the base 34 can be limited.

The resilient bands 38, 40 shown in the figures have zigzagged profile to confer the necessary flexibility to the resilient bands 38, 40. It is also possible, although not shown in the figures, to provide resilient bands having curved profile.

The base 34 comprises a first receiving portion 44 protruding from the surface of the base 34 facing the compacting plate 30. The first receiving portion 44 has a cross-section corresponding to the inner cross-section of a first end 46 of the spring 32. Similarly, the compacting plate 30 comprises a second receiving portion 48 protruding from the surface of the compacting plate 30 facing the base 32. The second receiving portion 48 has a cross-section corresponding to the inner cross-section of a second end 50 of the spring 32. In a compressed state, the spring 32 can be passed over the receiving portions 44, 48 and, once in place, the spring compacting plate 30 is allowed to expand so that the ends 46, 48 of the spring surround the respective receiving portions 44, 48. Once the spring 32, has been inserted between the compacting plate 30 and the base 34, the first receiving portion 44 protrudes into the first end 46 of the spring 32 and the second receiving portion 48 protrudes into the second end 50 of the spring 32, so that the spring 32 is securely maintained between the compacting plate 30 and the base 32. The first receiving portion 44 is formed in one piece with the base 34 and the second receiving portion 48 is formed in one piece with the compacting plate 30.

Figure 3:
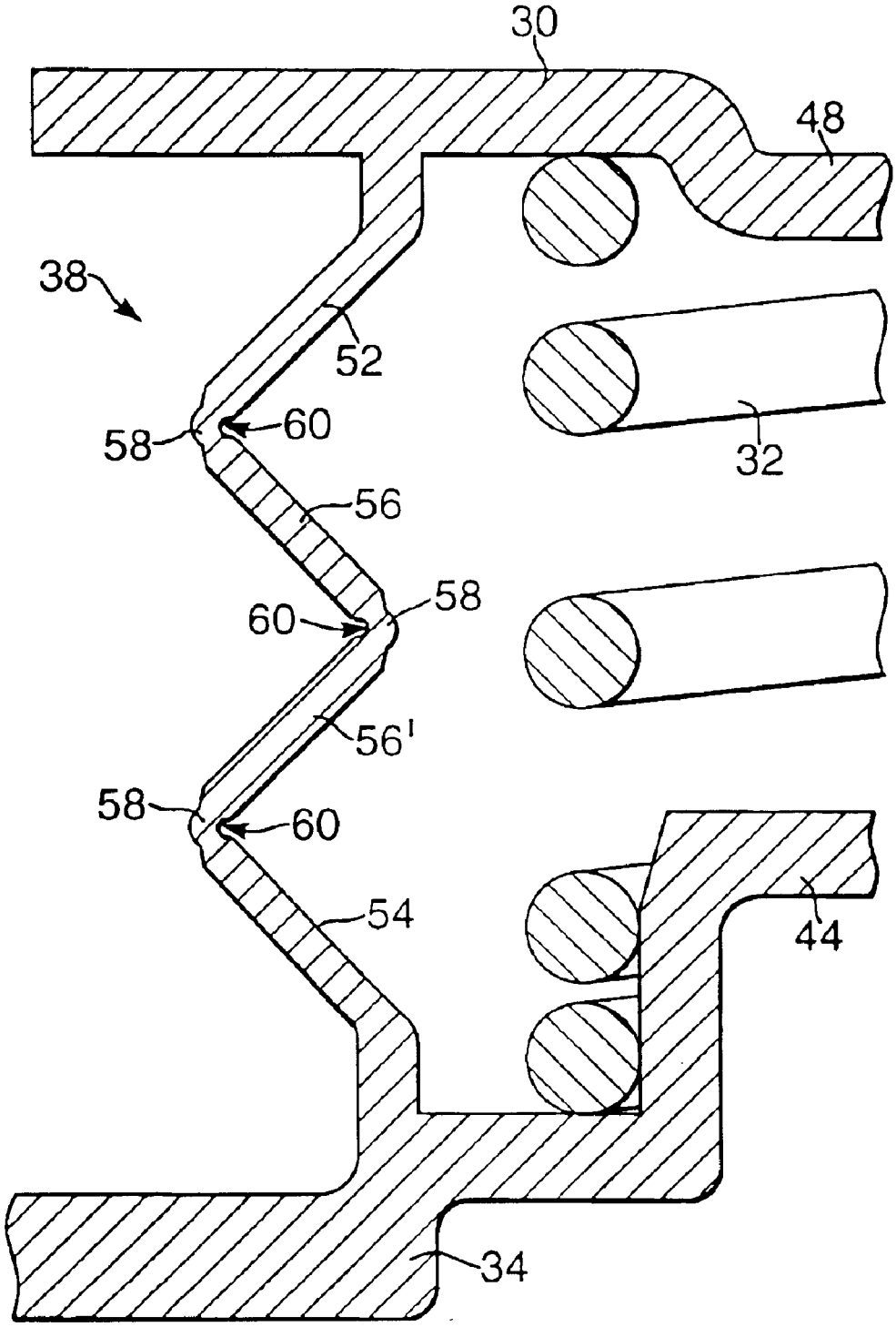
FIG. 3 is an enlarged section view through a part of the volume compensator of FIG. 2.

The resilient bands 38, 40 can be explained in more detail by referring to FIG. 3. An upper angled portion 52 is connected to the compacting plate 30 and a lower angled portion 54 is connected to the base 34. Intermediate portions 56, 56' are connected to each other and to the upper angled portion 52 and the lower angled portion 54. Bending areas 58 are formed in the region where the individual portions 52, 56, 56', 54 meet. Preferably the portions 52, 56, 56', 54 are formed in one piece with the compacting plate 30 and the base portion 34. In order to facilitate bending of the resilient band 38 in the bending area 58, a groove 60 is preferably arranged in one face of the resilient band 38 in the bending area 58.

Although not shown in the figures, it is also possible to configure the respective receiving portions 44, 48 as recesses wherein the first and second ends 46, 50 of the spring 32 can be received.

It is finally to be noted that, although the above description describes a vertical-placed type integrated canister, a horizontal-placed type integrated canister is not excluded.

What is claimed is:

1. Evaporated fuel processing device, in particular for an internal combustion engine of an automotive vehicle, comprising:

a tank port and an atmospheric port;

a first adsorbent chamber between said tank port and said atmospheric port, said first adsorbent chamber being filled with an adsorbent material; and a volume compensator for compacting said adsorbent material in said first adsorbent chamber, wherein said volume compensator comprises: a base;

a compacting plate; and a spring arranged between said base and said first compacting plate, characterized by resilient connecting means connecting said compacting plate to said base, said resilient connecting means being formed in one piece with said compacting plate and said base and said resilient connecting means being arranged such that said spring can be inserted between said base and said first compacting plate.

2. Evaporated fuel processing device according to claim 1, wherein said resilient connecting means comprises first and second resilient bands, said first and second resilient bands being diametrically arranged in a peripheral zone of said compacting plate.

3. Evaporated fuel processing device according to claim 2, wherein said resilient connecting means comprises a third resilient band, said third resilient band being arranged between said first and second resilient bands in said peripheral of said compacting plate.

4. Evaporated fuel processing device according to claim 2, wherein said resilient bands have larger width than thickness.

5. Evaporated fuel processing device according to any of claims 2, wherein said resilient bands have zigzagged or curved profile.

6. Evaporated fuel processing device according to claim 1, wherein said base comprises a first receiving portion for receiving said spring.

7. Evaporated fuel processing device according to claim 6, wherein said compacting plate comprises a second receiving portion for receiving said spring.

8. Evaporated fuel processing device according to claim 7, wherein said receiving portions protrude into an area between said base and said compacting plate, and said receiving portions have a cross-section substantially corresponding to the inner cross-section of said spring.

9. Evaporated fuel processing device according to claim 7, wherein said receiving portions are formed by a recess arranged in said base and said compacting plate respectively, and said receiving portions have a cross-section substantially corresponding to the outer cross-section of said spring.

10. Evaporated fuel processing device according to claim 7, wherein said first receiving portion is formed in one piece with said base, and said second receiving portion is formed in one piece with said compacting plate.

11. Evaporated fuel processing device according to claim 1, further comprising:

a second adsorbent chamber arranged between said first adsorbent chamber and said atmospheric port, said second adsorbent chamber being filled with an adsorbent material;

wherein said volume compensator comprises:

a first compacting plate associated with a first spring for compacting said adsorbent material in said first adsorbent chamber, and a second compacting plate associated with a second spring for compacting said adsorbent material in said second adsorbent chamber.

12. Evaporated fuel processing device according to claim 11, wherein said volume compensator is fluidly arranged between said first and second adsorbent chambers, said volume compensator defining a compensator chamber, and said first and second compacting plates comprising passages having a cross-section allowing an air/fuel vapor mixture to pass through said passages but preventing said adsorbent material to pass through said passages.

13. Evaporated fuel processing device according to claim 11, further comprising a third adsorbent chamber arranged between said second adsorbent chamber and said atmospheric port, said third adsorbent chamber being filled with an adsorbent material, wherein said evaporated fuel processing device comprises a further volume compensator for compacting said adsorbent material in said third adsorbent chamber.

14. Evaporated fuel processing device according to claim 1, wherein said adsorbent material comprises activated carbon.

15. Evaporated fuel processing device according to claim 1, further comprising a purge port connected to said first adsorbent chamber.

* * * * *